US010470548B2

(12) United States Patent
Son et al.

(10) Patent No.: US 10,470,548 B2
(45) Date of Patent: Nov. 12, 2019

(54) COSMETIC CONTAINER HAVING IDENTIFICATION MEANS

(71) Applicant: YONWOO CO., LTD., Incheon (KR)

(72) Inventors: Su-Jin Son, Incheon (KR); Min-Goo Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 15/754,828

(22) PCT Filed: Jul. 6, 2016

(86) PCT No.: PCT/KR2016/007324
§ 371 (c)(1),
(2) Date: Feb. 23, 2018

(87) PCT Pub. No.: WO2017/034150
PCT Pub. Date: Mar. 2, 2017

(65) Prior Publication Data

US 2018/0249805 A1 Sep. 6, 2018

(30) Foreign Application Priority Data

Aug. 24, 2015 (KR) ..... 10-2015-0118537

(51) Int. Cl.
*A45D 34/00* (2006.01)
*A45D 40/00* (2006.01)
(Continued)

(52) U.S. Cl.
CPC ..... *A45D 34/00* (2013.01); *A45D 40/00* (2013.01); *B05B 11/3047* (2013.01);
(Continued)

(58) Field of Classification Search
CPC ..... A45D 34/00; A45D 40/00; A45D 25/00
(Continued)

(56) References Cited

U.S. PATENT DOCUMENTS 2,686,081 A * 8/1954 Cooksley ..... A62C 13/003 128/200.23
7,775,402 B2 * 8/2010 Yoshida ..... B05B 11/3059 222/153.13
(Continued)

FOREIGN PATENT DOCUMENTS

FR 2864046 A1 6/2005
JP 2004-276974 A 10/2004
(Continued)

OTHER PUBLICATIONS

International Search Report issued in PCT Patent Application No. PCT/KR2016/007324 dated Nov. 1, 2016.
(Continued)

*Primary Examiner* — Vishal Pancholi
(74) *Attorney, Agent, or Firm* — Marshall, Gerstein & Borun LLP

(57) ABSTRACT

A cosmetic container having an identification means, wherein a user can intuitively identify contents through the identification means by providing an identification means for identifying contents at the upper portion of the container body, such that it is possible to easily classify cosmetic products according to contents when storing the cosmetics, thereby providing user convenience.

5 Claims, 8 Drawing Sheets

(51) Int. Cl.
*B65D 25/00* (2006.01)
*B65D 47/00* (2006.01)
*B05B 11/00* (2006.01)

(52) U.S. Cl.
CPC ..... *B65D 25/00* (2013.01); *B65D 47/00* (2013.01); *A45D 2200/051* (2013.01); *A45D 2200/052* (2013.01); *A45D 2200/056* (2013.01); *B05B 11/0032* (2013.01); *B05B 11/00416* (2018.08); *B05B 11/3023* (2013.01); *B05B 11/3069* (2013.01); *B05B 11/3074* (2013.01)

(58) Field of Classification Search
USPC ..... 222/153.13, 182, 321.3, 321.6–321.9, 222/384, 519, 571
See application file for complete search history.

(56) References Cited

U.S. PATENT DOCUMENTS 7,845,521 B2 * 12/2010 Blake ..... B05B 9/0883 222/207
8,863,988 B2 * 10/2014 Kang ..... B65D 55/02 222/153.13
2004/0238572 A1 12/2004 Blake
2006/0163869 A1 7/2006 Adler et al.
2012/0267391 A1 * 10/2012 Yoo ..... A45D 34/00 222/41
2014/0319176 A1 * 10/2014 Dolos ..... B65D 23/00 222/143

FOREIGN PATENT DOCUMENTS

JP 2012-250733 A 12/2012
KR 20-0177195 Y1 6/2002
KR 20-0370276 Y1 12/2004
KR 10-1212940 B1 12/2012
KR 2012-0133536 A 12/2012
KR 2014-0044540 A 4/2014

OTHER PUBLICATIONS

Supplementary European Search Report issued in European Patent Application No. 16839440 dated Mar. 11, 2019.
Office Action issued in Korean Patent Application No. 10-2015-0118537 dated Jan. 10, 2017.

* cited by examiner

COSMETIC CONTAINER HAVING IDENTIFICATION MEANS

TECHNOLOGICAL FIELD

The present disclosure relates to a cosmetic container having an identification means, wherein a user can intuitively identify contents through the identification means by providing an identification means for identifying contents at the upper portion of the container body, such that it is possible to easily classify cosmetic products according to contents when storing the cosmetics, thereby providing user convenience.

BACKGROUND

Generally, cosmetics containers receive various types of contents such as skin lotion, lotion, eye cream, and others, and when using, a user either opens an over cap from a container body and applies the contents stored in the container body or discharge the contents through pumping operation by means of a pumping device.

Usually, these are classified into basic cosmetics, like lotion and skin lotion, and color cosmetics, like essence, functional cosmetics, and foundation. When applying cosmetics, a user should check whether they are basic cosmetics or color cosmetics by reading what is written on the surface of the container body, which is inconvenient.

Meanwhile, recently diverse and a variety of cosmetic products are being produced, such as the cosmetic products for men the eco-friendly cosmetic products, the devices by which a user can intuitively classify cosmetic products are being demanded.

SUMMARY OF THE DISCLOSURE

The disclosed embodiments are devised to solve the problems stated in the above, and the objective of the disclosed embodiments is to provide to a cosmetic container having an identification means, wherein a user can intuitively identify contents through the identification means by providing an identification means for identifying contents at the upper portion of the container body, such that it is possible to easily classify cosmetics according to contents when storing the cosmetics, thereby providing user convenience.

To solve the problems in the above, a cosmetic container having an identification means according to the first exemplary embodiment includes: a container body storing contents; a support body provided with a coupling part for being coupled to the upper portion of the container body and provided with a cylinder supporting a pumping member at the center portion thereof; a pumping member coupled to the support body and discharging contents through pumping operation; and a button member coupled to the support body and performing a pumping operation, and further forming a contents discharge hole for contents to be discharged through, characterized in that the coupling part is coupled to the upper inner circumferential surface of the container body and fixes the support body to the container body, and at the support body is coupled an identification part which is exposed to the outside through the upper end opening portion of the container body in a state of being secured at the upper end of the coupling part and displays colors which makes it possible to classify cosmetic products.

Furthermore, it is characterized to comprise a fixation tube which pressurizes the upper end of the identification part and is coupled to the support body, thereby blocking the upward movement of the identification part and preventing the identification part from being separated out of the support body.

Furthermore, it is characterized to comprise a guide tube which encases the cylinder from the upper surface of the support body and protrudes upwards, thereby guiding the identification part and the fixation tube to be coupled.

On the other hands, a cosmetic container having an identification means according to the second exemplary embodiment includes: a container body storing contents and provided with a discharge part where contents are discharged at the upper portion thereof; a pumping member disposed at the upper portion of the container body and discharging contents through pumping operation; a fixation cap fixing the pumping member to the upper portion of the container body; and a button member coupled to the support body and pressurizing the pumping member, further provided with a contents discharge hole for contents to be discharged through, characterized to further comprises: a support body which is composed of a securing part with a securing groove encasing the upper end portion of the container body and depressed downwards from the upper surface thereof, and an extension part protruding upwards from the securing part for encasing the fixation cap and having a penetration hole at the center portion such that the button member can ascend and descend; and an identification part which is exposed to the outside in a state of being secured on the securing groove of the securing part, and displays colors which makes it possible to classify cosmetic products.

Furthermore, it is characterized in that a plurality of separation-preventing holes coupled to with a predetermined distance are provided at the securing part such that the identification part can be prevented from being separated upwards, and a plurality of separation-preventing protrusions which are coupled to the separation-preventing holes are provided at the lower end of the identification part.

On the other hands, a cosmetic container having an identification means according to the third exemplary embodiment includes: a container body; an inner container coupled to the inner side of the container body and storing contents; and an over cap opening and closing the upper end opening portion of the inner container, characterized in that at the inner side of the container body is provided a fixation part protruding upwards from the bottom surface thereof and fixing the inner container, at the lower portion of the inner container is provided a coupling part screw-coupled to the fixation part of the container body, and at the upper portion of the inner container is provided an identification part which extends as encasing the outer circumferential surface thereof and is exposed to the outside through the upper end opening portion of the container body in a state of being secured at the upper end of the container body, and further displays colors which makes it possible to classify cosmetic products.

As described in the above, according to embodiments which are equipped with an identification means for identifying contents at the upper portion of the container body, it is possible for a user to intuitively identify contents through the identification means and to easily classify cosmetic products according to contents when storing the cosmetics, thereby providing user convenience.

DETAILED DESCRIPTION

Figure 1:
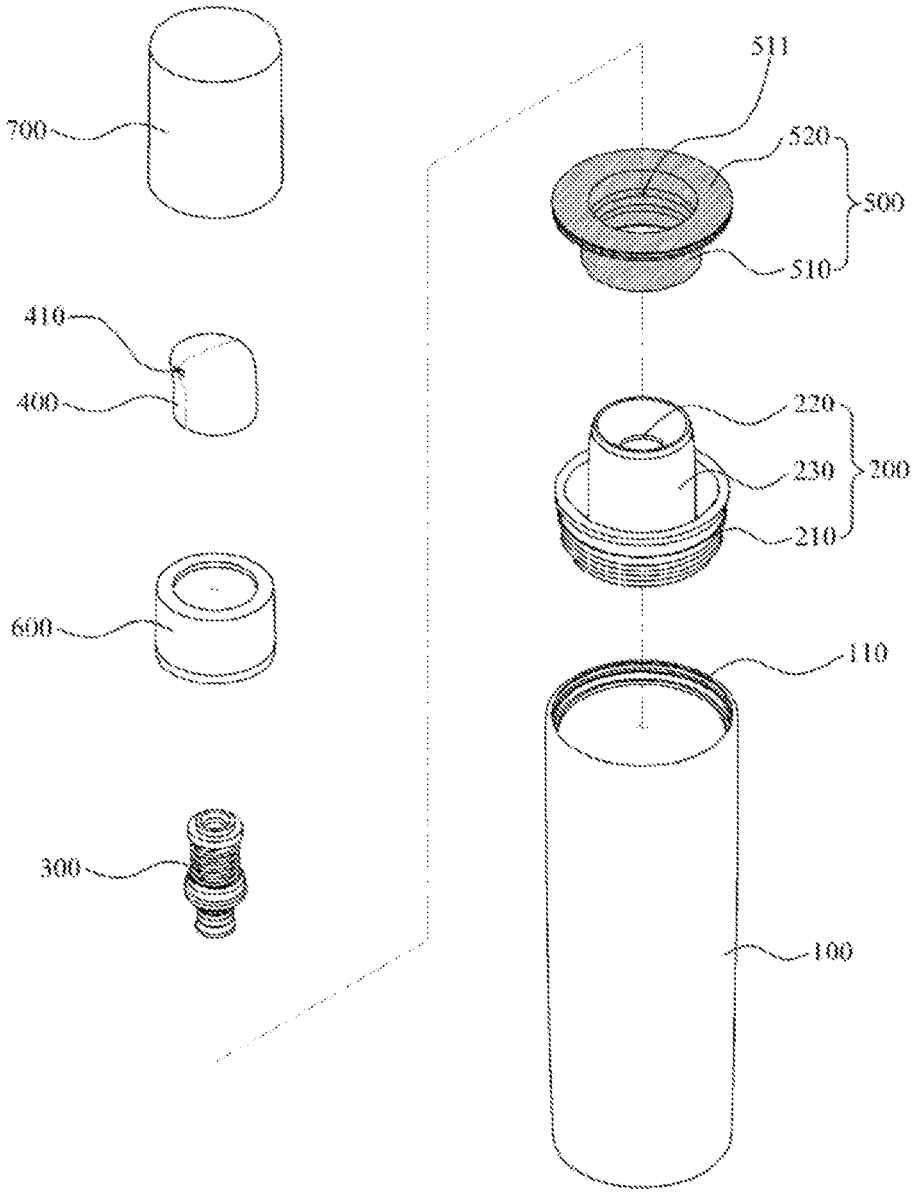
FIG. 1 is an exploded perspective view illustrating a configuration of a cosmetic container having an identification means according to the first exemplary embodiment.

Hereinafter, exemplary embodiments will be described in detail with reference to the accompanying drawings. The same reference numerals provided in the drawings indicate the same members.

Figure 2:
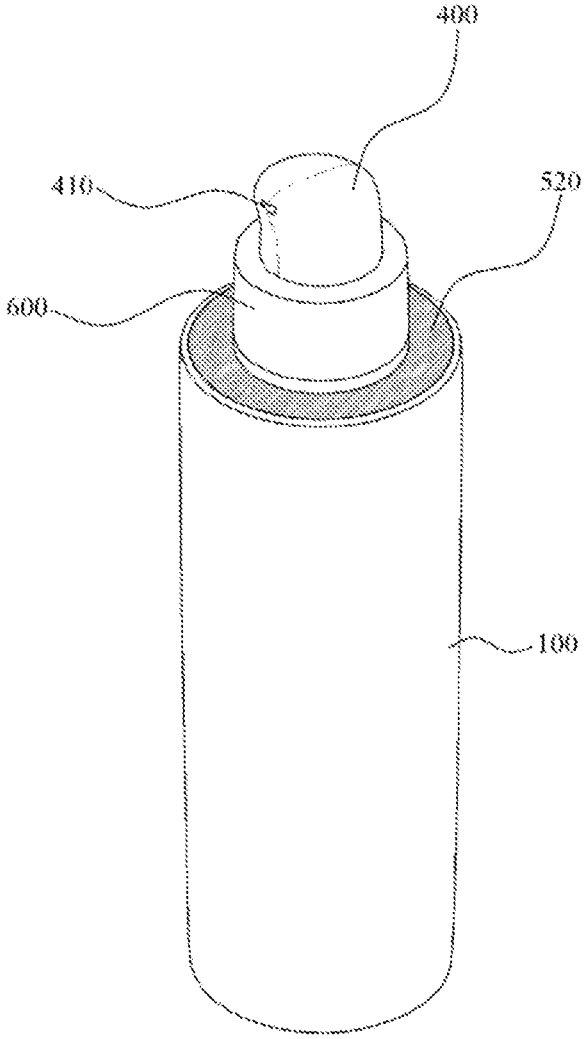
FIG. 2 is an assembled perspective view illustrating a configuration of a cosmetic container having an identification means according to the first exemplary embodiment.
Figure 3:
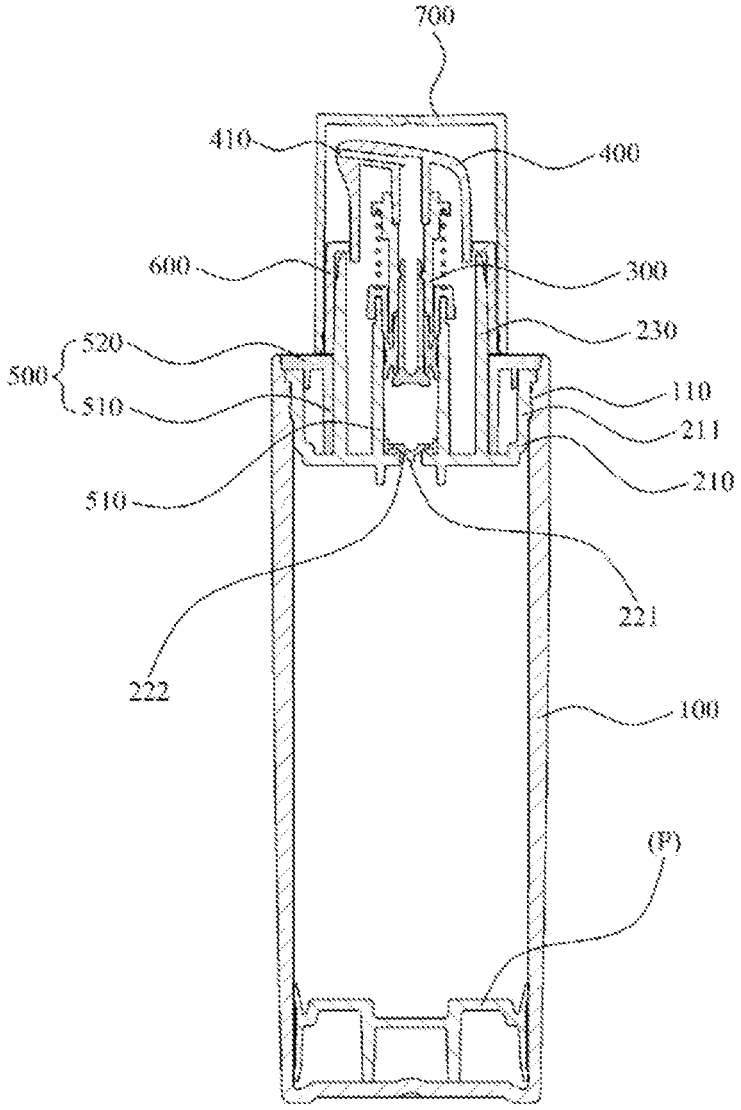
FIG. 3 is an assembled cross-sectional view illustrating a configuration of a cosmetic container having an identification means according to the first exemplary embodiment.

FIG. 1 is an exploded perspective view illustrating a configuration of a cosmetic container having an identification means according to the first exemplary embodiment. FIG. 2 is an assembled perspective view illustrating a configuration of a cosmetic container having an identification means according to the first exemplary embodiment. FIG. 3 is an assembled cross-sectional view illustrating a configuration of a cosmetic container having an identification means according to the first exemplary embodiment.

Referring to FIGS. 1 to 3, a cosmetic container having an identification means according to an exemplary embodiment includes a container body 100, a support body 200, a pumping member 300, a button member 400, an identification part 500, and a fixation tube 600.

The container body 100, storing contents, is provided with a piston P which ascends according to the contents use at the inner lower portion thereof.

The present embodiments are characterized in that at the inner circumferential surface of the container body 100 is provided a fixation protrusion 110, which is coupled to a coupling protrusion 211 formed at the outer circumferential surface of a coupling part 210, to be described later, of the support body 200, such that the support 200 can be fixed at inner side of the container body 100 through the coupling of the fixation protrusion 110 and the coupling protrusion 211.

The support body 200, coupled to the upper portion of the container body 100 and supporting the pumping member 300, includes a coupling part 210, a cylinder 220, and a guide tube 230.

The coupling part 210, coupled to the upper inner circumferential surface of the container body 100 and fixing the support body 200 to the container body 100, is provided with a coupling protrusion 211 which is coupled with the fixation protrusion 110 of the container body 100.

The cylinder 220 extends upwards from the center portion of the support body 200 and supports the pumping member 300, thereby forming a space where the piston of the pumping member 300 ascends and descends, wherein at the lower end of the cylinder 220 is provided a contents inflow hole 221 such that contents stored in the container body 100 can flow in when the pumping member 300 operates, and at the inner side thereof is installed a check valve 222 which opens and closes the contents inflow hole 221 according to the operation of the pumping member 300.

The guide tube 230 encases the cylinder 220 from the upper surface of the support body 200 and protrudes upwards, wherein at the outer circumferential surface thereof is preferably provided a fixation means for making it possible to fix an identification part 500 and a fixation tube 600.

The pumping member 300, which is coupled to the cylinder 220 of the support body 200 and discharges contents through pumping operation, is composed of: a stem, one side of which is coupled to the inner side of a button member 400, to be described later, and the other side of which is placed at the inner side of the cylinder 220, thereby moving together according to the upward and downward movement of the button member 400; a piston rod which is coupled to the lower portion of the stem; a seal cap which is coupled as encasing the outer circumferential surface of the piston rod at the lower portion of the piston rod and moves along the inner wall of the cylinder 220; and a spring which is coupled as encasing the circumference of the stem provides an elastic force in the upward direction such that the button part 400 can have a repeated pumping operation.

The constitution of the pumping member 300 is well known in the technical field to which these embodiments belong, and a detailed description thereof will be omitted.

The button member 400, coupled to the upper portion of the pumping member 300 and causing the pumping member 300 to perform pumping operation by pressurizing the pumping member 300 according to user's manipulation, is provided with a contents discharge hole 410 at one side thereof such that contents can be discharged through.

The identification part 500, configured to be coupled to the support body 200 and to be exposed to the outside through the upper end opening portion of the container body 100 in a state of being secured at the upper end of a coupling part 210 of the support body 200, is composed of a coupling tube 510 which encases the outer circumferential surface of the guide tube 230 and has a hollow 511 formed, and a securing plate 520 which encases the outer circumferential surface of the upper end of the coupling tube 510 and extends to be secured at the upper end of the coupling part 210.

Because the identification part 500 is characterized to display colors which makes it possible to classify cosmetic products, a user can intuitively identify cosmetic products through colors displayed on the identification part 500, such that it is easy for a user to classify cosmetic products according to the cosmetic products when storing, thereby providing user's convenience.

The fixation tube 600, coupled for pressurizing the upper end of the identification part 500 as encasing the outer circumferential surface of the guide tube 230, pressurizes the upper end of the identification part 500 in a state of being secured at the support body 200 and prevents the identification part 500 from moving upwards, thereby preventing the identification part 500 from being separated out of the support body 200.

Meanwhile, at the outer side of the fixation tube 600 is detachably coupled an over cap 700 which encases the button member 400.

Hereinafter, with reference to FIGS. 4 to 6, a cosmetic container having an identification means according to the second exemplary embodiment will be described.

Figure 4:
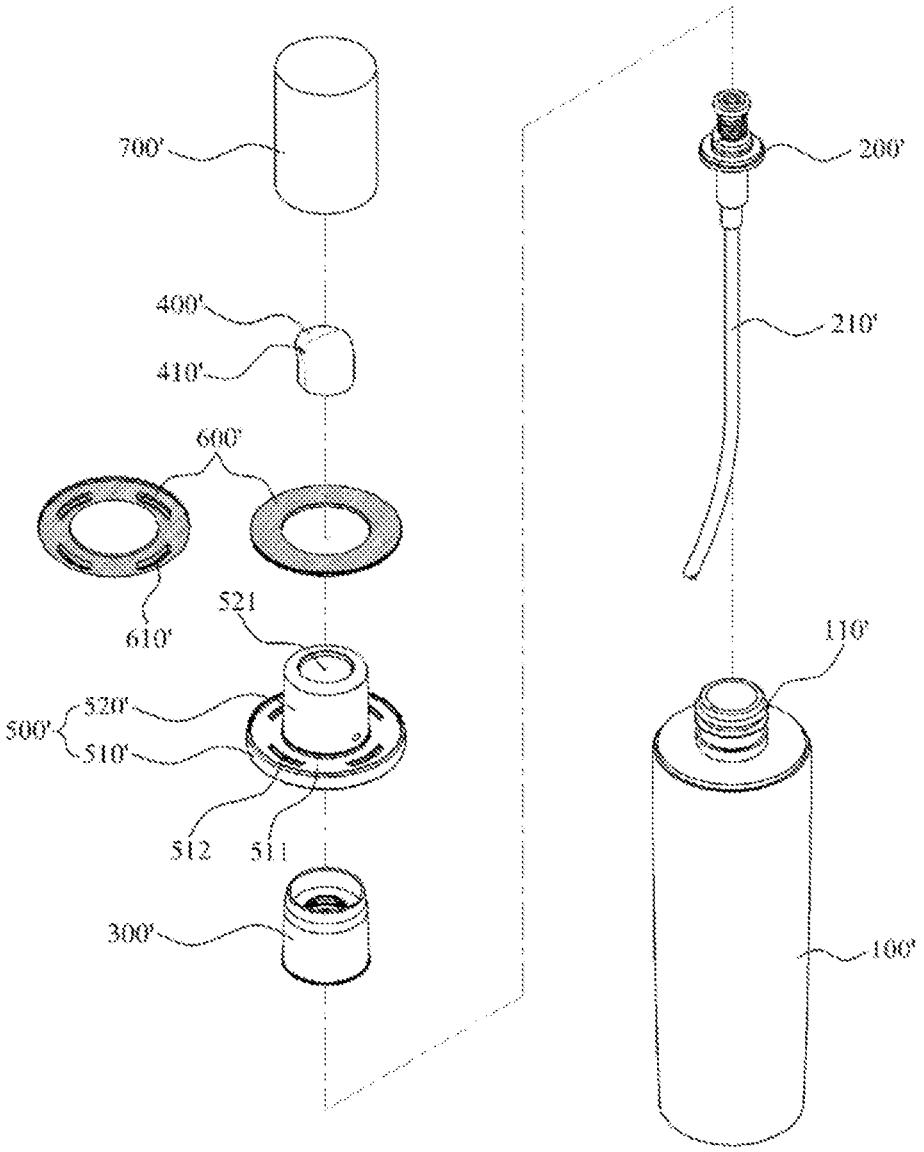
FIG. 4 is an exploded perspective view illustrating a configuration of a cosmetic container having an identification means according to the second exemplary embodiment.
Figure 5:
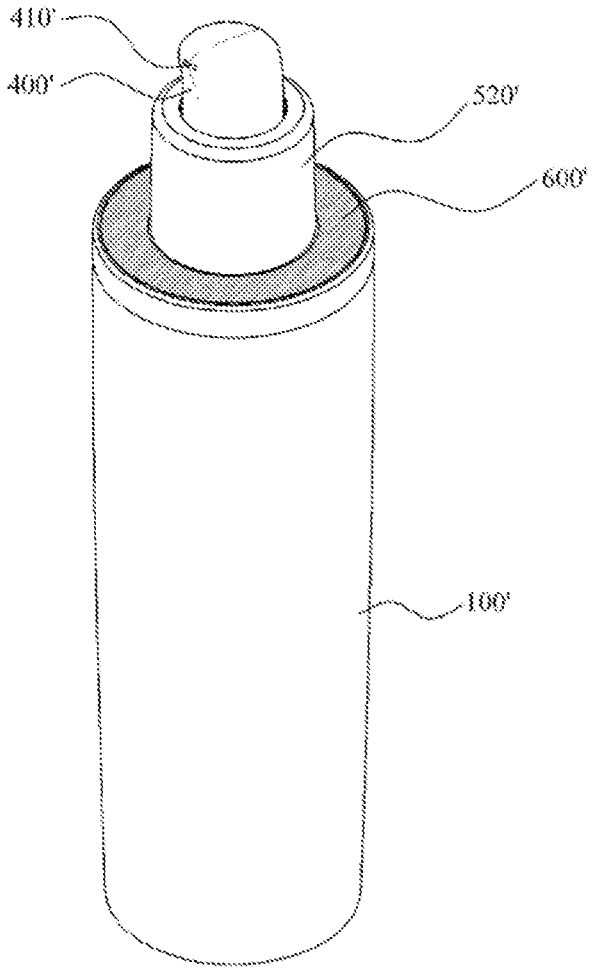
FIG. 5 is an assembled perspective view illustrating a configuration of a cosmetic container having an identification means according to the second exemplary embodiment.
Figure 6:
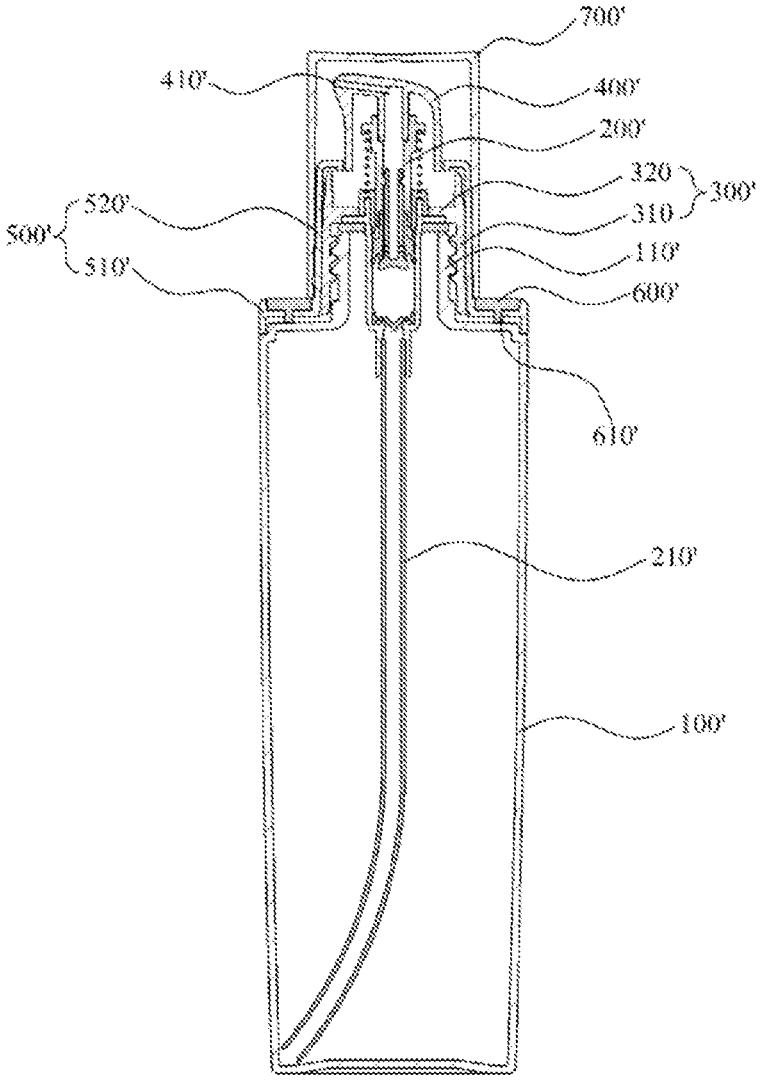
FIG. 6 is an assembled cross-sectional view illustrating a configuration of a cosmetic container having an identification means according to the second exemplary embodiment.

Referring to FIGS. 4 to 6, a cosmetic container having an identification means according to the second exemplary embodiment includes a container body 100', a pumping member 200', a fixation cap 300', a button member 400', a support body 500' and an identification part 600'.

The container body 100', storing contents, is provided with a discharge part 110' at the upper portion thereof such that contents stored in the container body 100' can be discharged.

The pumping member 200', disposed at the upper portion of the container body 100' and discharging the contents through pumping operation, is coupled with a contents absorption tube 210' which absorbs the contents stored in the container body 100'.

The constitution of the pumping member 200' is the same as described in the second exemplary embodiments, and therefore, a detailed description thereof will be omitted.

The fixation cap 300', fixing the pumping member 200' to the upper portion of the container body 100', is composed of a coupling part 310 which is screw-coupled to the discharge part 110' and fixes the fixation cap 300' to the container body 100', and a support projection 320 which extends to the inner side of the fixation cap 300' at the upper portion of the coupling part 310 and pressurizes the pumping member 200'.

It is preferable that a hollow is formed at the fixation cap 300' such that the pumping member 200 can penetrate through.

The button member 400', coupled to the pumping member 200' and making the pumping member 200' perform pumping operation by pressurizing the pumping member 200' according to user's manipulation, is provided with a contents discharge hole 410' at one side thereof such that contents can be discharged through.

The support body 500', encasing the upper end of the container body 100' and the fixation cap 300' and coupled to the fixation cap 300', includes a securing part 510' and an extension part 520'.

The securing part 510', encasing the upper end of the container body 100', is provided with a securing groove 511' depressed downwards from the upper surface thereof such that an identification part 600', to be described later, can be secured and coupled thereon. A plurality of separation-preventing holes 512 with a predetermined distance apart is provided at the securing groove 511 such that the identification part 600' can be prevented from being coupled with a separation-preventing protrusion 610 and being separated upwards.

The extension part 520', protruding upwards from the securing part 510' for encasing the fixation cap 300', is provided with a penetration hole 521' at the center portion thereof such that the button member 400' can ascend and descend.

Meanwhile, an over cap 700', encasing the button member 400', is detachably coupled at the outer side of the support body 500'.

The identification part 600', coupled to the support body 500' and exposed to the outside in a state of being secured at the upper end of the securing groove 511 of the securing part 510', is composed of a doughnut shape to encase the extension part 520', wherein at the lower end thereof is provided a plurality of separation-preventing protrusions 610 coupled to the separation-preventing holes 512.

The identification part 600' is characterized to display colors capable of distinguishing cosmetic products, as described in the first embodiment. The various colors displayed on the identification part 600' makes it possible for a user to intuitively classify cosmetic products, such that the user can easy classify the cosmetic products when storing.

Hereinafter, with reference to FIGS. 7 to 9, a cosmetic container having an identification means according to the second exemplary embodiment will be described.

Figure 7:
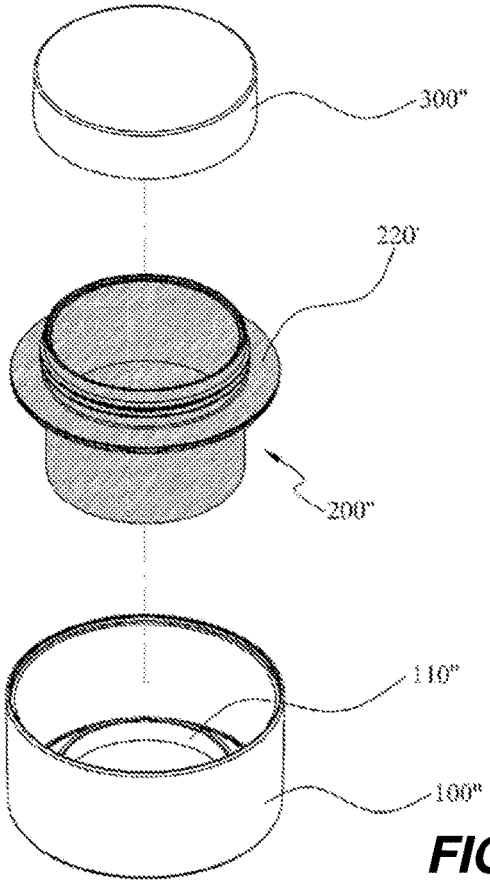
FIG. 7 is an exploded perspective view illustrating a configuration of a cosmetic container having an identification means according to the third exemplary embodiment.
Figure 8:
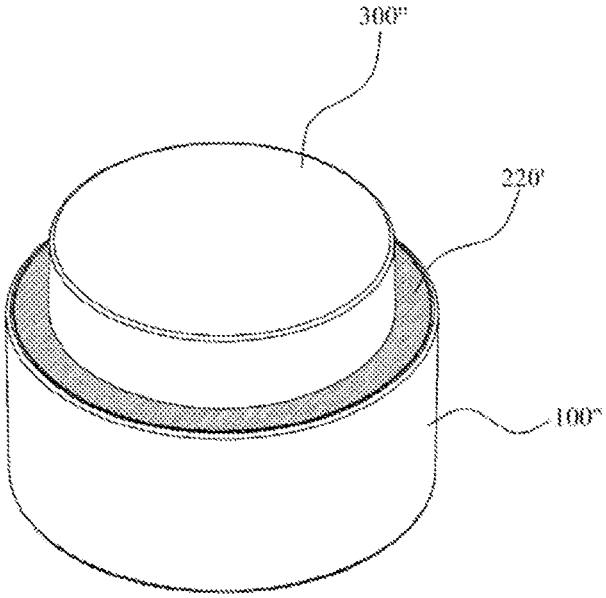
FIG. 8 is an assembled perspective view illustrating a configuration of a cosmetic container having an identification means according to the third exemplary embodiment.
Figure 9:
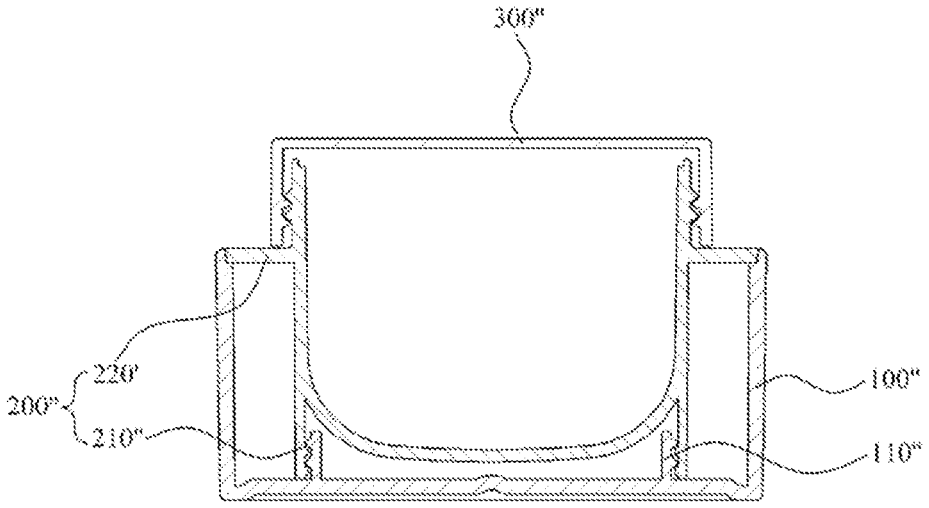
FIG. 9 is an assembled cross-sectional view illustrating a configuration of a cosmetic container having an identification means according to the third exemplary embodiment.

Referring to FIGS. 7 to 9, a cosmetic container having an identification means according to the third exemplary embodiment includes a container body 100", an inner container 200", and an over cap 300".

The container body 100", receiving an inner container 200", has the upper end thereof formed open such that the inner container 200" can be received therein, wherein at the inner side thereof is provided a fixation part 110" which protrudes upwards from the bottom surface and fixes the inner container 200".

The inner container 200", coupled at the inner side of the container body 100" and storing contents therein, is provided with a coupling part 210" which is screw-coupled to the fixation part 110" of the container body 100" and fixes the inner container 200" to the container body 100".

The present embodiments are characterized in that at the upper portion of the inner container 200" is provided an identification part 220', which extends as encasing the outer circumferential surface and is exposed to the outside through the opening portion of the upper end of the container body 100" in a state of being secured on the upper end of the container body 100". The identification part 220', as described in the third exemplary embodiments, displays colors capable of distinguishing cosmetic products, such that a user can intuitively identify colors of the cosmetic products, displayed on the identification part 220'. Therefore, it is possible for a user to easily classify and store the cosmetic products, thereby providing user's convenience.

The over cap 300", opening an closing an opening and closing part of the upper end of the inner container 200" and detachably coupled to the container body 100", stopping foreign matters or air from entering and thereby preventing decomposition of the contents.

As described above, optimal embodiments have been disclosed in the drawings and the specification. Although specific terms have been used herein, these are only intended to describe the embodiments and are not intended to limit the meanings of the terms or to restrict the scope of the accompanying claims. Therefore, those skilled in the art will appreciate that various modifications and other equivalent embodiments are possible from the above embodiments. Therefore, the scope of the claims should be defined by the technical spirit of the disclosure.

What is claimed is:

1. A cosmetic container having an identification means, the container comprising:

a container body storing contents;

a support body provided with a coupling part for being coupled to an upper portion of the container body and provided with a cylinder supporting a pumping member at a center portion thereof;

a pumping member coupled to the support body and discharging contents through pumping operation; and a button member coupled to the support body and performing a pumping operation, and further forming a contents discharge hole for contents to be discharged through, wherein the coupling part is coupled to an upper inner circumferential surface of the container body and fixes the support body to the container body, and is formed with a coupling groove depressed downwards at an inner side thereof, and wherein, at the support body, is coupled an identification part which is exposed to the outside through an upper end opening portion of the container body in a state of being secured at an upper end of the coupling part and displays colors which makes it possible to classify cosmetic products, including a securing plate which extends, as encasing a coupling tube coupled to the coupling groove, and is secured to the upper end of the coupling part.

2. The cosmetic container having an identification means of claim 1, further comprising a fixation tube which pressurizes an upper end of the identification part and is coupled to the support body, thereby blocking the upward movement of the identification part and preventing the identification part from being separated out of the support body.

3. The cosmetic container having an identification means of claim 2, further comprising a guide tube which encases the cylinder from an upper surface of the support body and protrudes upwards, thereby guiding the identification part and the fixation tube to be coupled.

4. A cosmetic container having an identification means, comprising:

a container body storing contents and provided with a discharge part where contents are discharged at the upper portion thereof;

a pumping member disposed at an upper portion of the container body and discharging contents through pumping operation;

a fixation cap fixing the pumping member to the upper portion of the container body; and a button member coupled to the support body and pressurizing the pumping member, further provided with a contents discharge hole for contents to be discharged through, further comprising: a support body which is composed of a securing part with a securing groove encasing the upper end portion of the container body and depressed downwards from an upper surface thereof, and an extension part protruding upwards from the securing part for encasing the fixation cap and having a penetration hole at the center portion such that the button member can ascend and descend; and an identification part which is exposed to the outside in a state of being secured on the securing groove of the securing part, and displays colors which makes it possible to classify cosmetic products, wherein a plurality of separation-preventing holes coupled to with a predetermined distance are provided at the securing part such that the identification part can be prevented from being separated upwards, and a plurality of separation-preventing protrusions which are coupled to the separation-preventing holes are provided at a lower end of the identification part.

5. A cosmetic container having an identification means, comprising:

a container body;

an inner container coupled to an inner side of the container body and storing contents; and an over cap opening and closing an upper end opening portion of the inner container, wherein at the inner side of the container body is provided a fixation part protruding upwards from a bottom surface thereof and fixing the inner container, at a lower portion of the inner container is provided a coupling part screw-coupled to the fixation part of the container body, and at an upper portion of the inner container is provided an identification part which extends outward as encasing the outer circumferential surface thereof and exposed to the outside through an upper end opening portion of the container body in a state of being secured at an upper end of the container body, and further displays colors which makes it possible to classify cosmetic products therein.

* * * * *